US007712641B2

(12) United States Patent
Snyder

(10) Patent No.: US 7,712,641 B2
(45) Date of Patent: May 11, 2010

(54) SYSTEM AND METHOD FOR HANGING GARMENTS

(76) Inventor: Paula Ann Snyder, 9628 U.S. Highway 62, Orient, OH (US) 43146

( * ) Notice: Subject to any disclaimer, the term of this patent is extended or adjusted under 35 U.S.C. 154(b) by 20 days.

(21) Appl. No.: 12/212,896

(22) Filed: Sep. 18, 2008

(65) Prior Publication Data

US 2009/0078728 A1 Mar. 26, 2009

Related U.S. Application Data

(60) Provisional application No. 60/975,244, filed on Sep. 26, 2007.

(51) Int. Cl.
*A41D 27/22* (2006.01)

(52) U.S. Cl. ..... 223/88; 223/87; 211/85.3; 211/113

(58) Field of Classification Search ..... 223/85, 223/87, 88, 92; 211/85.2, 85.3, 113
See application file for complete search history.

(56) References Cited

U.S. PATENT DOCUMENTS 3,698,043 A * 10/1972 Batts ..... 223/87
4,387,873 A * 6/1983 Pavlo et al. ..... 211/113
4,401,219 A * 8/1983 Mink ..... 206/566
5,117,988 A * 6/1992 Daniels ..... 211/113
5,137,149 A * 8/1992 Polacek ..... 223/87
5,427,230 A * 6/1995 Mattox ..... 206/6.1
D377,123 S * 1/1997 Hutchens ..... D6/323
6,123,238 A * 9/2000 Dumplet ..... 211/113
6,808,064 B1 * 10/2004 Fanning ..... 206/286
7,389,868 B2 * 6/2008 Lewand et al. ..... 211/85.2
2005/0109802 A1 * 5/2005 Avery et al. ..... 223/85
2007/0119881 A1 * 5/2007 Murphy ..... 223/97

* cited by examiner

*Primary Examiner*—Gary L Welch
*Assistant Examiner*—Nathan E Durham
(74) *Attorney, Agent, or Firm*—Frost Brown Todd LLC

(57) ABSTRACT

A garment hanging system comprises a sheet, which has a first fastening member and a second fastening member. The fastening members may comprise hook and loop fasteners that are configured to engage one another. The sheet may be secured to a clothes hanger by folding a portion of the sheet over the horizontal member of the hanger and securing the first fastening member to the second fastening member. Alternatively, a hanger hook may be integrated into the sheet. The sheet also includes several hook members, which may be provided on one or both sides of the sheet. The hook members may be used to hang a plurality of garments from the sheet. For instance, the straps of a camisole may be hung from each pair of hook members. A single clothes hanger or hook may thus be used to support several camisoles simultaneously, in a vertically staggered arrangement.

3 Claims, 5 Drawing Sheets

SYSTEM AND METHOD FOR HANGING GARMENTS

PRIORITY

This application claims priority from the disclosure of U.S. Provisional Patent Application Ser. No. 60/975,244, entitled "System and Method for Hanging Garments," filed Sep. 26, 2007, the disclosure of which is incorporated by reference herein in its entirety.

BACKGROUND

Various types of garments have been hung in various ways over the years. The way in which a garment is hung may be based on a variety of factors, such as the configuration of the garment itself and the location in which the garment will be hung. While some systems and methods may be suitable for hanging certain types of garments, such systems and methods may not be ideal for hanging other types of garments. While a variety of systems and methods have been made and used for hanging garments, it is believed that no one prior to the inventor has made or used the invention recited in the appended claims.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

Reference will now be made in detail to various embodiments of the invention, examples of which are illustrated in the accompanying drawings. To the extent that specific dimensions are shown in the accompanying drawings, such dimensions should be regarded as merely illustrative and not limiting in any way. Accordingly, it will be appreciated that such dimensions may be varied in any suitable way.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

Figure 1:
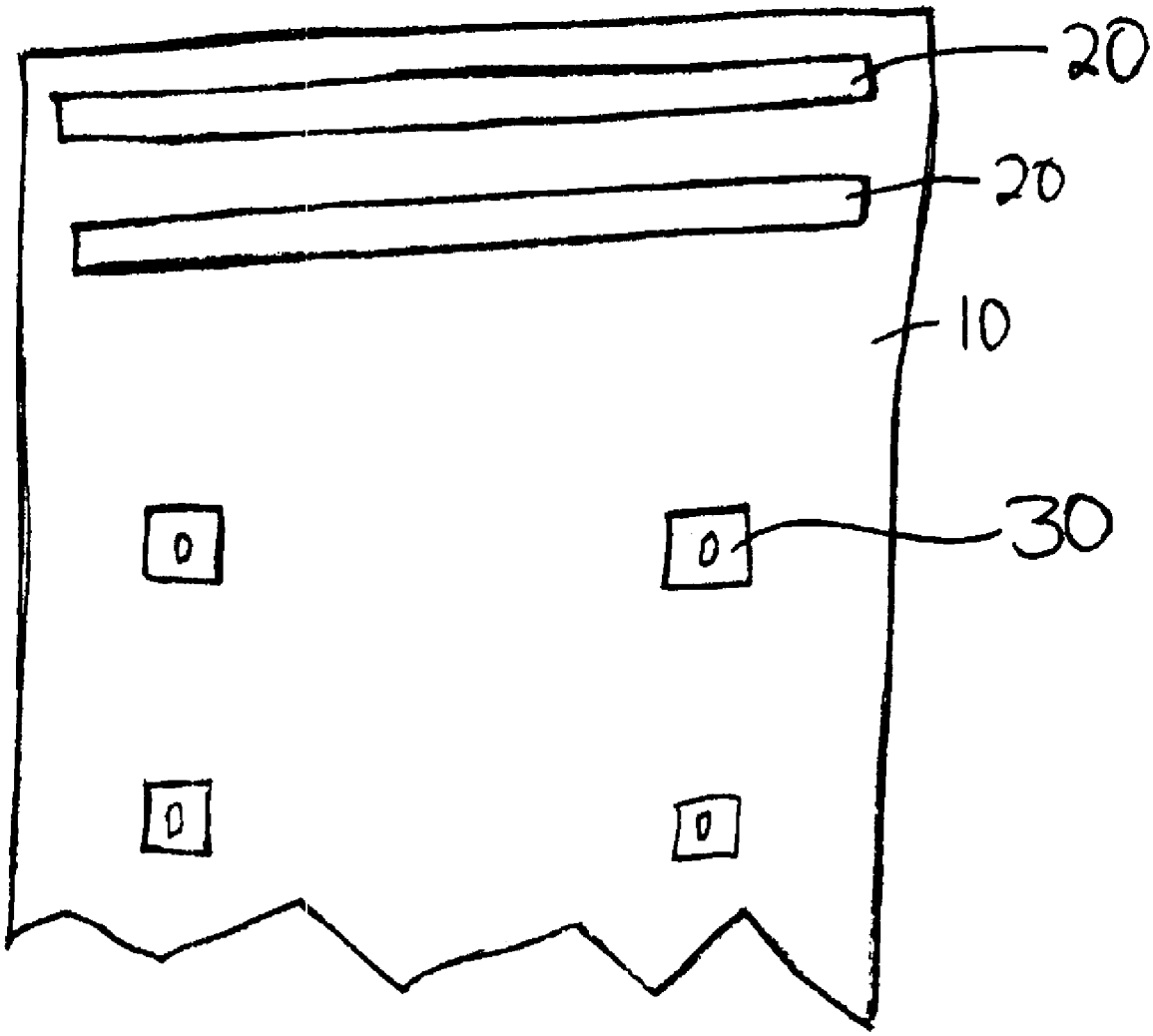
FIG. 1 depicts a front view of an exemplary garment hanging device.
Figure 2:
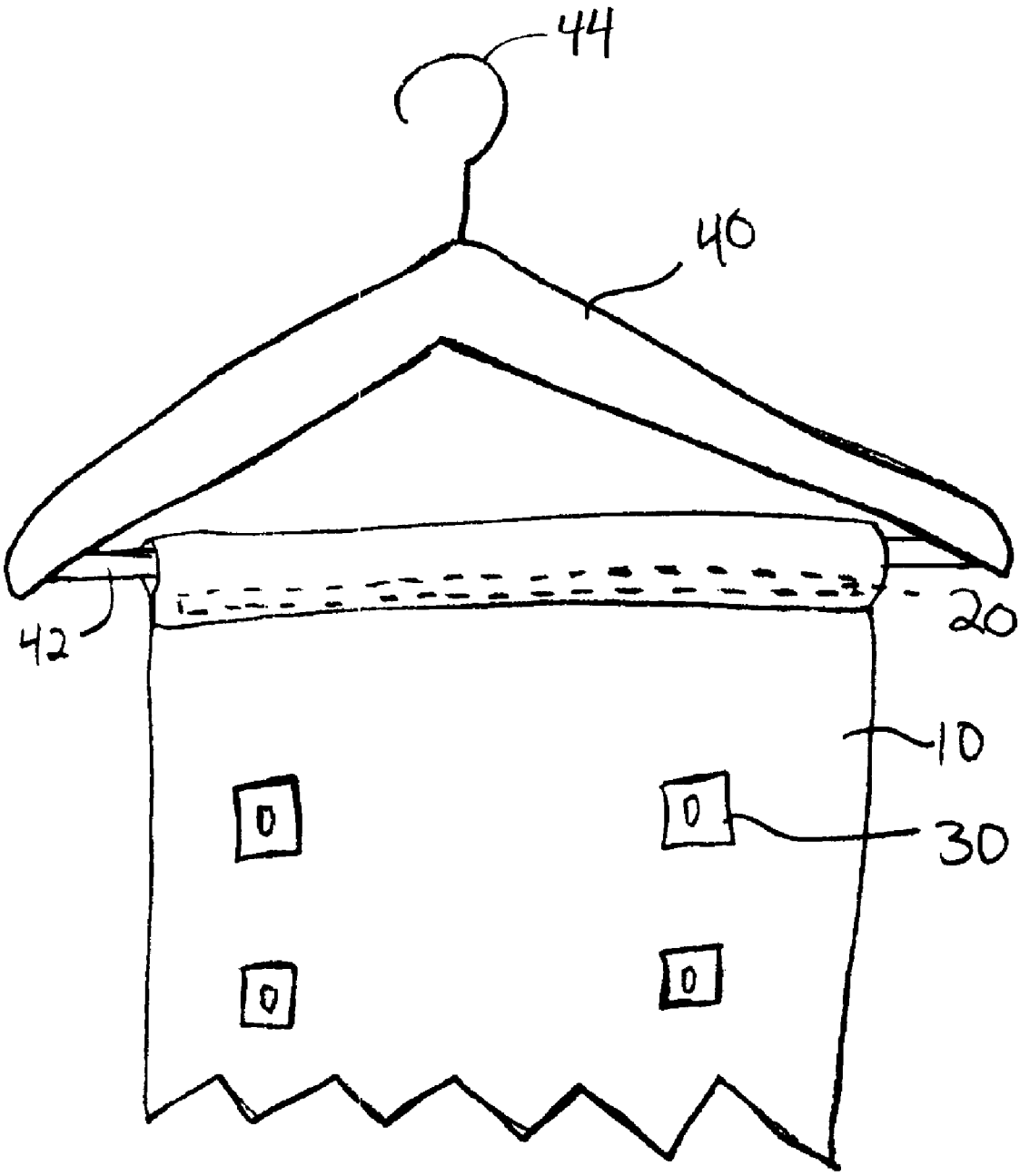
FIG. 2 depicts a front view of the garment hanging device of FIG. 1 secured to a hanger.
Figure 3:
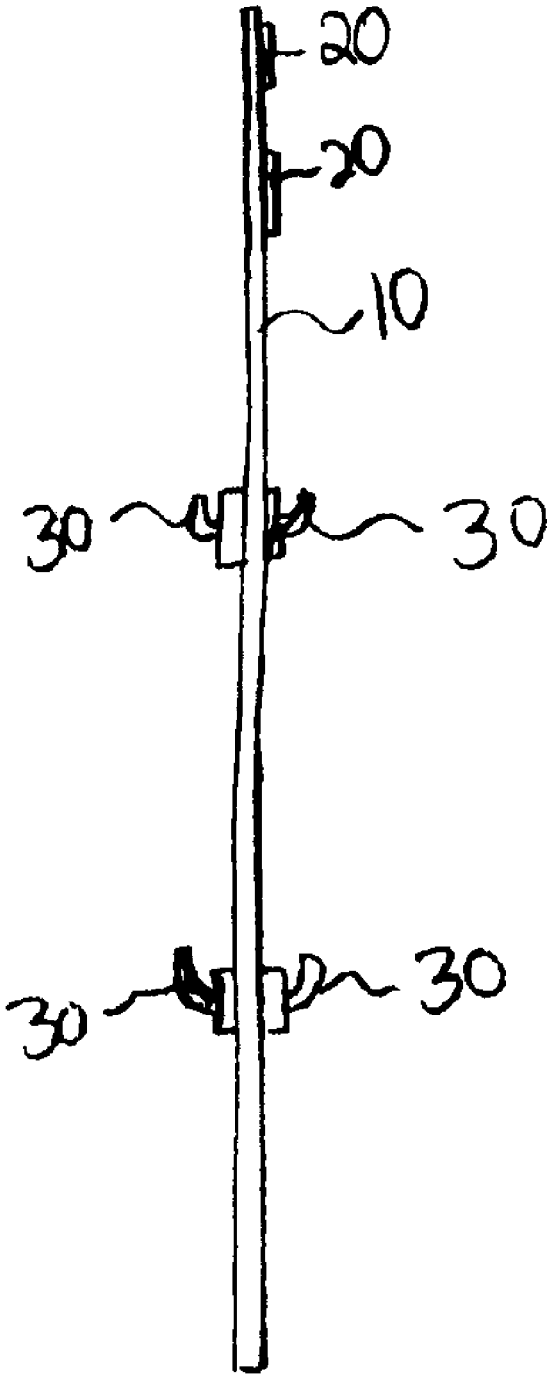
FIG. 3 depicts a side view of the garment hanging device of FIG. 1.

FIGS. 1-3 show an exemplary garment hanging device that comprises a sheet (10). As shown in FIG. 1, sheet (10) includes a pair of hook and loop fastening strips (20) (e.g., VELCRO strips, etc.) and a plurality of hook members (30). In some versions, sheet (10) is formed of a non-woven, polypropylene fabric, though any other suitable material or materials may be used. Sheet (10) is substantially thin, lightweight, and flexible in the present example, though sheet (10) may have other properties if desired. In some versions, sheet (10) is approximately 14 inches wide by approximately 36 inches long. Of course, any other suitable dimensions may be used.

Hook and loop fastening strips (20) that are provided on sheet (10) are configured to engage one another. For instance, one strip (20) may present a plurality of loops, while the other strip (20) presents a plurality of hooks that are configured to removably engage the loops of the other strip (20). By way of example only, as shown in FIG. 2, hook and loop fastening strips (20) may be used to secure the top portion of sheet (10) to a horizontal member (42) of a conventional clothes hanger (40), such as by folding over part of the top portion of sheet (10) such that one of the hook and loop fastening strips (20) engages the other of the hook and loop fastening strips (20). Alternatively, sheet (10) may be secured to a hanger (40) in any other suitable fashion, including but not limited to being secured to some component of hanger (40) other than horizontal member (42). Hanger (40) has a hook (44) that allows hanger (40) to be hung from a horizontal bar or rod in a closet, by way of example only, or from a variety of other structures in a variety of other locations. It should also be understood that sheet (10) may be secured to any suitable device or structure other than hanger (40), in any suitable fashion.

In some variations, only one hook and loop fastening strip (20) is provided (e.g., a hook strip only, etc.), and sheet (10) has a configuration to permit strip (20) to adhere directly to sheet (10) (e.g., by presenting some form of loops that may be engaged by hooks, etc.). Of course, any other suitable features may be used in lieu of or in addition to hook and loop fastening strips (20), including but not limited to snaps, buttons, a zipper, a pressure sensitive adhesive (e.g., with a peel-away strip), etc. By way of example only, sheet (10) may have a preformed pocket or loop region, into which a rod or other device may be inserted. Similarly, sheet (10) may be secured to any suitable object other than clothes hanger (40) in any suitable fashion, as desired.

Hook members (30) may be secured to sheet (10) using any suitable devices or techniques. For instance, hook members (30) of the present example include an adhesive backing, which may be used to adhere hook members (30) to sheet (10). Additional adhesive may be used to secure hook members (30) to sheet (10). Alternatively, any other suitable devices or techniques may be used to secure hook members (30) to sheet (10), including but not limited to snaps, buttons, sewing, hook and loop fasteners, etc. By way of example only, each hook member (30) may be pre-secured to a respective piece of fabric or other material (not shown) in any suitable fashion, and that piece of fabric or other material may be sewn to or otherwise secured to sheet (10). Still other suitable variations will be apparent to those of ordinary skill in the art in view of the teachings herein.

FIGS. 1-3 show four hook members (30) being secured to each side of sheet (10), such that sheet (10) has a total of eight hook members (30) secured thereto. However, it should be understood that any desired number of hook members (30) may be used in any desired arrangement on either or both sides of sheet (10). By way of example only, each side of sheet (10) may have eight hook members (30) secured thereto, such that the entirety of sheet (10) has a total of sixteen hook members (30) secured thereto.

In the present example, hook members (30) are formed of a plastic material. Alternatively, any other suitable material or combination of materials may be used to form hook members (30).

As shown in FIG. 3, hook members (30) protrude outwardly and upwardly from sheet (10). As also shown in FIG. 3, hook members (30) are provided on both sides of sheet (10). While the present example has hook members (30) being provided directly opposite one another on both sides of sheet (10), other versions may have hook members (30) staggered on both sides of sheet (10). Of course, other versions may alternatively have hook members (30) on only one side of sheet (10), or in any other suitable arrangement. Furthermore, any other suitable features may be added to either or both sides of sheet (10), in lieu of or in addition to hook members (30). Other suitable substitutes, supplements, and/or alternatives for hook members (30) will be apparent to those of ordinary skill in the art in view of the teachings herein.

Figure 4:
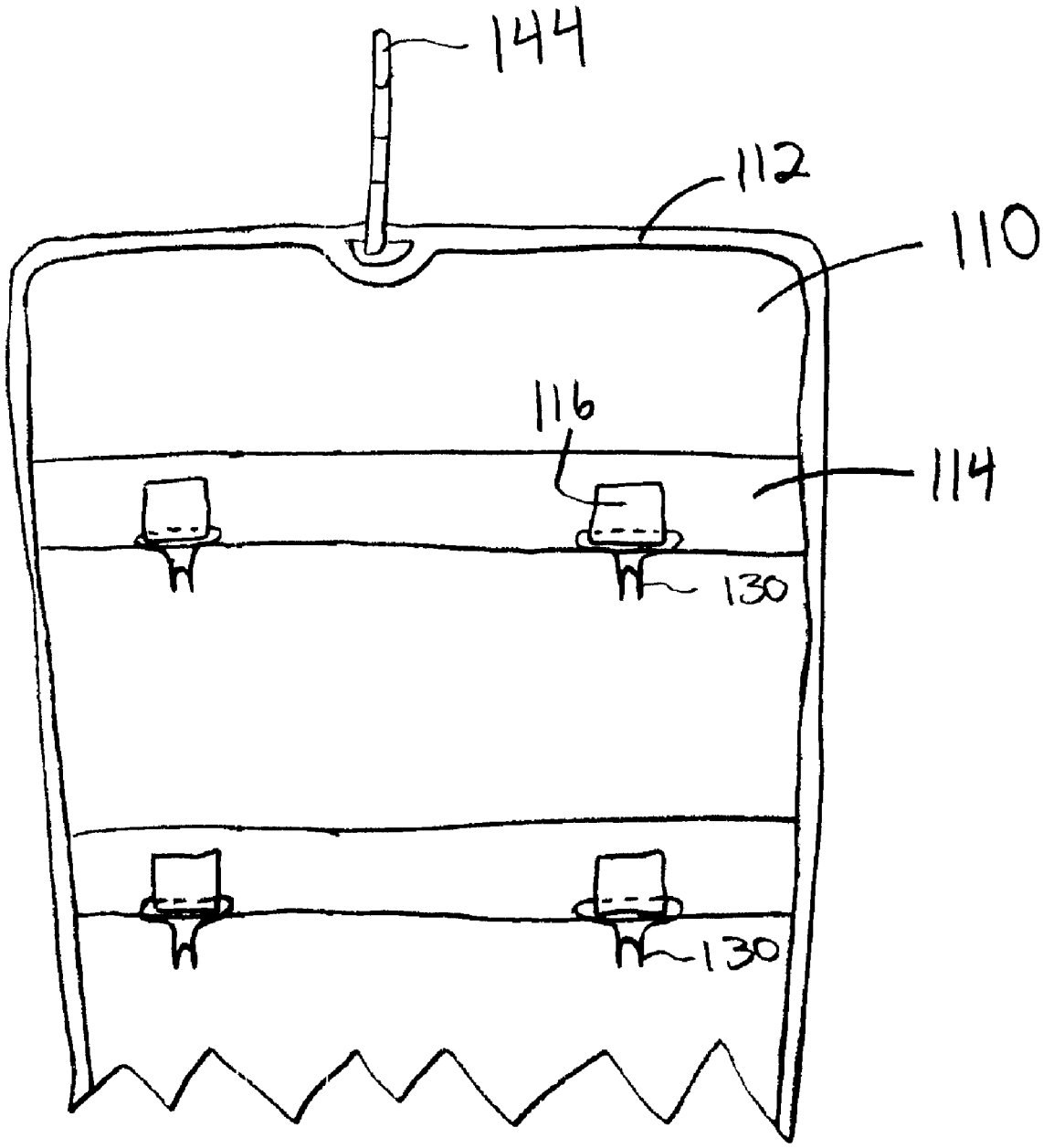
FIG. 4 depicts a front view of an exemplary variation of a garment hanging device.
Figure 5:
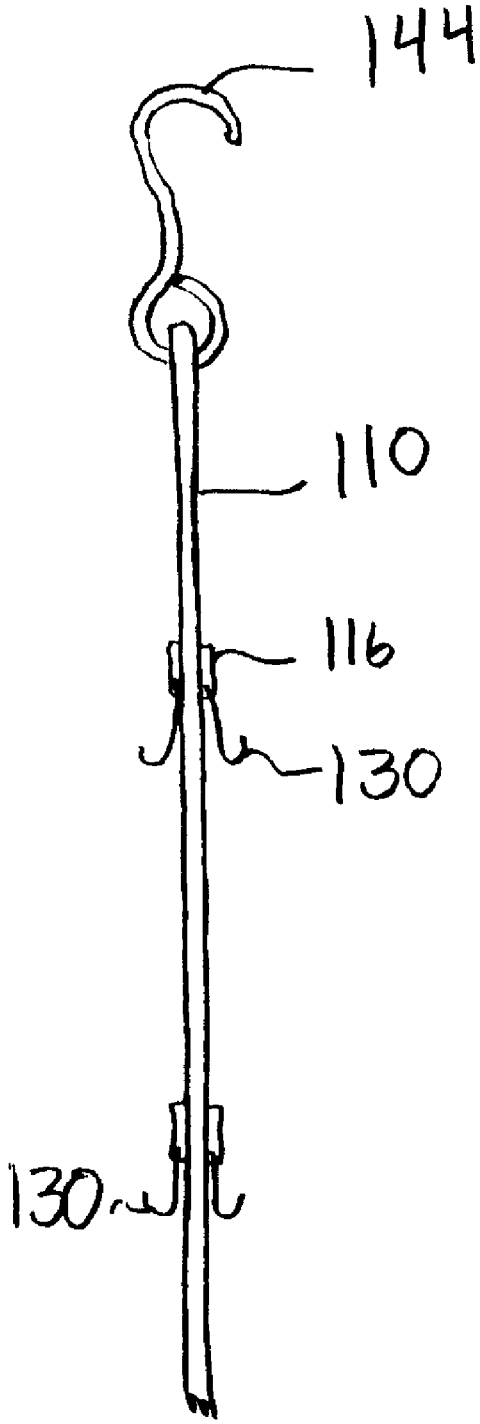
FIG. 5 depicts a side view of the garment hanging device of FIG. 4.

A merely exemplary variation of sheet (10) is shown in FIGS. 4-5. As shown, sheet (110) includes a plurality of hook members (130) and a hanger hook (144). Sheet (110) may have at least some of the properties of sheet (10) described above. For instance, sheet (110) may also be constructed of a polypropylene material or any other suitable material, including combinations thereof. In addition, sheet (110) includes nylon reinforcement (112) about its outer perimeter and nylon reinforcement strips (114) oriented horizontally across each side of sheet (110). Of course, any other suitable material(s) may be used in any suitable fashion to reinforce sheet (110) and/or for other purposes. Other ways in which sheet (110) may be configured will be apparent to those of ordinary skill in the art in view of the teachings herein.

As noted above, sheet (110) includes an integrated hanger hook (144). Hanger hook (144) is formed of metal in this example, though any other suitable material or combinations of materials may be used, including but not limited to plastic, etc. Hanger hook (144) is configured similar to the hook (44) of hanger (40) described above and shown in FIG. 2. For instance, hook (144) may allow sheet (110) to be hung from a horizontal bar or rod in a closet, by way of example only, or from a variety of other structures in a variety of other locations. Thus, in this example, a separate hanger (40) is not necessarily needed in order to hang sheet (110). Of course, sheet (110) may be modified to include one or more features (e.g., hook and loop fastening strips (20), etc.) that permit sheet (110) to be secured to a hanger (40). It should therefore be understood that any components or features of sheet (10) described herein may be incorporated into sheet (110). Similarly, any components or features of sheet (110) described herein may be incorporated into sheet (10). Accordingly, the inventor does not intend for any components or features described herein to be exclusive to the particular examples through which they are introduced. Suitable variations of sheets (10, 110) will be apparent to those of ordinary skill in the art in view of the teachings herein.

Hooks (130) of the present example are formed of metal, though any other suitable material or combinations of materials may be used, including but not limited to plastic, etc. Hooks (130) are secured to horizontal reinforcement strips (114) by straps (116). Straps (116) of this example are formed of nylon, though any other suitable material or combination of materials may be used. Horizontal reinforcement strips (114) are sewn to sheet (110) in this example, and straps (116) are sewn to both horizontal reinforcement strips (114) and sheet (110). Alternatively, straps (116) may be secured to sheet (110) or relative to sheet (110) in any other suitable fashion. Similarly, hooks (130) may be secured to sheet (110) or relative to sheet (110) in a variety of other ways, including but not limited to variations in which straps (116) are omitted.

Like hook members (30) described above, hooks (130) are provided on both sides of sheet (110). Any desired number of hooks (130) may be provided on either side or both sides of sheet (110) (e.g., four pairs of hooks (130) on each side of sheet (110), etc.). Hooks (130) also protrude outwardly and upwardly from sheet (110) in this example. While the present example has hooks (130) being provided directly opposite one another on both sides of sheet (110), other versions may have hooks (130) staggered on both sides of sheet (110). Of course, other versions may alternatively have hooks (130) on only one side of sheet (10), or in any other suitable arrangement. Furthermore, any other suitable features may be added to either or both sides of sheet (110), in lieu of or in addition to hooks (130). Other suitable substitutes, supplements, and/or alternatives for hooks (130) will be apparent to those of ordinary skill in the art in view of the teachings herein.

As shown in FIG. 2, hook (44) of hanger (40) is oriented such that it is substantially parallel with sheet (10). Accordingly, when hook (44) of hanger (40) is hung on a horizontal rod or bar (e.g., in a closet), sheet (10) will be oriented substantially perpendicular to such a horizontal rod or bar. By contrast, and as shown in FIGS. 4-5, hanger hook (144) is oriented such that it is substantially perpendicular to sheet (110). Accordingly, when hanger hook (144) is hung on a horizontal rod or bar (e.g., in a closet), sheet (110) will be oriented substantially parallel to such a horizontal rod or bar. It should be understood, however, that sheets (10, 110) and/or any structure by which sheets (10, 110) are hung may be otherwise configured such that a hung sheet (10, 110) has any suitable orientation relative to a horizontal rod or bar or other structure on which sheet (10, 110) is hung. Furthermore, hook (44) and/or hanger hook (144) may be configured to swivel, such that the orientation of sheet (10, 110) may be adjusted.

In one merely exemplary use of the systems described herein, garments such as camisoles (not shown) are hung on hook members (30, 130). For instance, the straps of a camisole, or similar components of other garments, may be hung on hook members (30, 130), such that a plurality of camisoles or other garments may be hung from sheet (10, 110). Thus, when sheet (10) is hung from a hanger (40), it will be appreciated that several camisoles or other garments may be supported by a single hanger (40). Similarly, in the context of sheet (110), several camisoles or other garments may be supported by a single hanger hook (144). For instance, several camisoles may be hung in a vertically staggered fashion along each side of sheet (10, 110) (e.g., a first camisole hung from hook members (30, 130) near the bottom of one side of sheet (10, 110), a second camisole hung from hook members (30, 130) at the middle of the same side of sheet (10, 110), a third camisole hung from hook members (30, 130) near the bottom of the same side of sheet (10, 110), and a similar arrangement of camisoles on the other side of sheet (10, 110), etc.). In one version where sheet (10, 110) has a four pairs of hook members (30, 130) on each side of sheet (10, 110), a total of eight camisoles may be hung on sheet (10, 110) (e.g., four camisoles on each side of sheet (10, 110)). A given pair of hook members (30, 130) may also be used to hang a plurality of camisoles or other garments, such that any desired number of camisoles or other garments may be hung from sheet (10, 110). Other garments that may be used with sheet (10, 110) will be apparent to those of ordinary skill in the art in view of the teachings herein, as will other suitable uses for sheet (10, 110).

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

What is claimed is:

1. A garment hanging system, comprising:

(a) a sheet, wherein the sheet has a first side and a second side, wherein the sheet has an outer perimeter, wherein the sheet has a vertical height, wherein the sheet has a horizontal width, wherein the vertical height is greater than the horizontal width, wherein the sheet is formed of fabric;

(b) a first hook integrally secured to the sheet, wherein the first hook is configured to engage a horizontal support;

(c) a plurality of nylon reinforcement strips, the plurality of nylon reinforcement strips comprising:

(i) a perimeter nylon strip secured to the outer perimeter of the sheet, and (ii) a plurality of horizontal nylon strips sewn to the first side of the sheet, wherein the plurality of horizontal nylon strips extend across the entire horizontal width of the sheet, wherein the plurality of horizontal nylon strips are vertically spaced apart from each other along the vertical height of the sheet;

(d) a plurality of nylon straps fixedly sewn to the plurality of horizontal nylon strips, such that each horizontal nylon strip includes a respective pair of the nylon straps; and a plurality of hook members secured to the sheet, wherein the hook members are provided in pairs on each horizontal nylon strip of the plurality of horizontal nylon strips, wherein each hook member comprises a horizontally extending portion and a hook portion, wherein the hook portion of each hook member extends vertically downwardly from the corresponding horizontally extending portion then vertically upwardly to terminate in a vertically upwardly oriented hook tip, wherein the vertically upwardly oriented hook tip of each hook member is spaced apart from the first side of the sheet such that the vertically upwardly oriented hook tip defines a gap between the vertically upwardly oriented hook tip and the first side of the sheet, wherein a corresponding nylon strap of the plurality of nylon straps secures the horizontally extending portion of each hook member to the corresponding horizontal strip, wherein each of the hook members is formed of a selected one of metal or plastic, wherein each pair of hook members is configured to engage one or more garments.

2. The garment hanging system of claim 1, wherein the fabric comprises polypropylene.

3. The garment hanging system of claim 1, wherein the hook members are secured to both sides of the sheet.

* * * * *